US008070314B2

(12) United States Patent
St. Ives et al.

(10) Patent No.: US 8,070,314 B2
(45) Date of Patent: Dec. 6, 2011

(54) PUSH FIT WATERPROOF INTERCONNECT FOR LIGHTING FIXTURES

(75) Inventors: Laurence St. Ives, Los Angeles, CA (US); Kevin Dahlen, Lindenhurst, IL (US)

(73) Assignee: Orgatech Omegalux, Inc., Azusa, CA (US)

( * ) Notice: Subject to any disclaimer, the term of this patent is extended or adjusted under 35 U.S.C. 154(b) by 256 days.

(21) Appl. No.: 12/549,211

(22) Filed: Aug. 27, 2009

(65) Prior Publication Data

US 2011/0051407 A1 Mar. 3, 2011

(51) Int. Cl.
*F21S 4/00* (2006.01)

(52) U.S. Cl. ..... 362/225; 362/219; 362/267; 362/645; 362/649; 362/217.13

(58) Field of Classification Search ..... 362/217.01, 362/219, 225, 217.1, 217.12, 217.13, 217.14, 362/217.16, 217.17, 267, 645, 649
See application file for complete search history.

(56) References Cited

U.S. PATENT DOCUMENTS

| | | | | |
|---|---|---|---|---|
| 1,968,072 | A | 7/1934 | Creighton | |
| 2,812,506 | A | 11/1957 | Merrill | |
| 3,515,862 | A | 6/1970 | Spivey | |
| 4,164,783 | A | 8/1979 | Wandler | |
| 4,245,281 | A | 1/1981 | Ziaylek, Jr. | |
| 4,293,847 | A | 10/1981 | McCarty | |
| 4,323,954 | A | 4/1982 | Florence et al. | |
| 4,543,623 | A | 9/1985 | Ehret | |
| 4,597,032 | A * | 6/1986 | Kirby | 362/145 |
| 4,598,346 | A | 7/1986 | Bodde | |
| 4,680,682 | A | 7/1987 | Parker | |
| 4,734,834 | A | 3/1988 | Petzl et al. | |
| 4,782,430 | A | 11/1988 | Robbins et al. | |
| 4,827,386 | A | 5/1989 | Mackiewicz | |
| 5,386,355 | A | 1/1995 | Acks | |
| 5,738,435 | A | 4/1998 | Lin et al. | |
| 5,799,124 | A | 8/1998 | Zorn et al. | |
| 5,997,320 | A | 12/1999 | DeMello | |
| 6,022,237 | A | 2/2000 | Esh | |
| 6,045,383 | A | 4/2000 | Fujiwara | |
| 6,053,623 | A | 4/2000 | Jones et al. | |
| 6,082,878 | A | 7/2000 | Doubek et al. | |
| 6,116,750 | A | 9/2000 | Hentz | |
| 6,161,948 | A | 12/2000 | Hagen | |
| 6,523,982 | B1 | 2/2003 | Haddad | |
| 6,554,457 | B1 | 4/2003 | Platt | |
| 6,663,261 | B1 | 12/2003 | Rhee | |
| 6,893,144 | B2 | 5/2005 | Fan | |
| 7,334,945 | B2 * | 2/2008 | Bina et al. | 385/88 |
| 2002/0106931 | A1 | 8/2002 | Hsien-Te | |
| 2006/0034072 | A1 | 2/2006 | Shih | |
| 2006/0114681 | A1 | 6/2006 | Wang | |
| 2006/0256561 | A1 | 11/2006 | Smith | |
| 2007/0019403 | A1 | 1/2007 | Boghossian | |

* cited by examiner

*Primary Examiner* — Stephen F Husar
*Assistant Examiner* — James Cranson, Jr.
(74) *Attorney, Agent, or Firm* — DLA Piper LLP (US)

(57) ABSTRACT

A push fit waterproof interconnect hub for a sequence of lighting fixtures. Each interconnect hub is formed as part of a special end cap of the lighting fixture. The interconnect hubs include a waterproof interconnect system that allows pass-through of electrical dabbling.

18 Claims, 6 Drawing Sheets

PUSH FIT WATERPROOF INTERCONNECT FOR LIGHTING FIXTURES

BACKGROUND OF THE PRESENT INVENTION

The present invention is directed to the field of lighting fixtures for mounting fluorescent light bulbs and/or light emitting diode arrays ("LED arrays"). More specifically the present invention is directed to a push fit waterproof interconnection hub allowing, the coupling of two or more lighting fixtures.

For architectural lighting, it is often desirable to couple one or more lighting fixtures together in a series so as to provide lighting for an extended distance. Each lighting fixture may, for example, be able to accommodate a fluorescent light bulb that is 3 to 5 feet in length. However, fluorescent light bulbs generally are not provided in lengths greater than 5 feet. Accordingly, for a lighting arrangement which needs to have lighting fixtures that are longer than the length of a standard fluorescent bulbs, it is beneficial to be able to couple two or more fixtures together so as to accommodate the extended length requirement.

For outdoor lighting requirements, it is generally also required to have a degree of waterproof capability so as to prevent moisture from getting into and being trapped within the lighting fixture. Accordingly, it is known to have coupling systems at the ends of lighting fixtures which allow for both pass-through of electrical cabling as well as the secure positioning of one fixture with respect to the adjacent fixture. One example would be a threaded locking sleeve which may be screwed onto an abutting threaded receiver so as to secure adjacent fixtures. The disadvantage of these types of systems, however, is their ridged placement and potential requirement for tools to be able to fix the components together and, once they are fixed together, their relative inability to independently rotate to provide lighting at different angles for different surfaces.

SUMMARY OF THE PRESENT INVENTION

The present invention is directed to a push fit waterproof interconnect hub for a sequence of lighting fixtures. Each interconnect hub is formed as part of a special end cap of the lighting fixture. The interconnect hubs include a waterproof interconnect system that allows pass-through of electrical cabling. The hub includes a hollow axial pass-through area so as to allow standard electrical cabling to be run between respective fixtures. When interconnected, the interconnect hubs allow for the relative rotation of the sequential fixtures so as to allow aiming of the output light.

DETAILED DESCRIPTION OF THE PRESENT INVENTION

Figure 1:
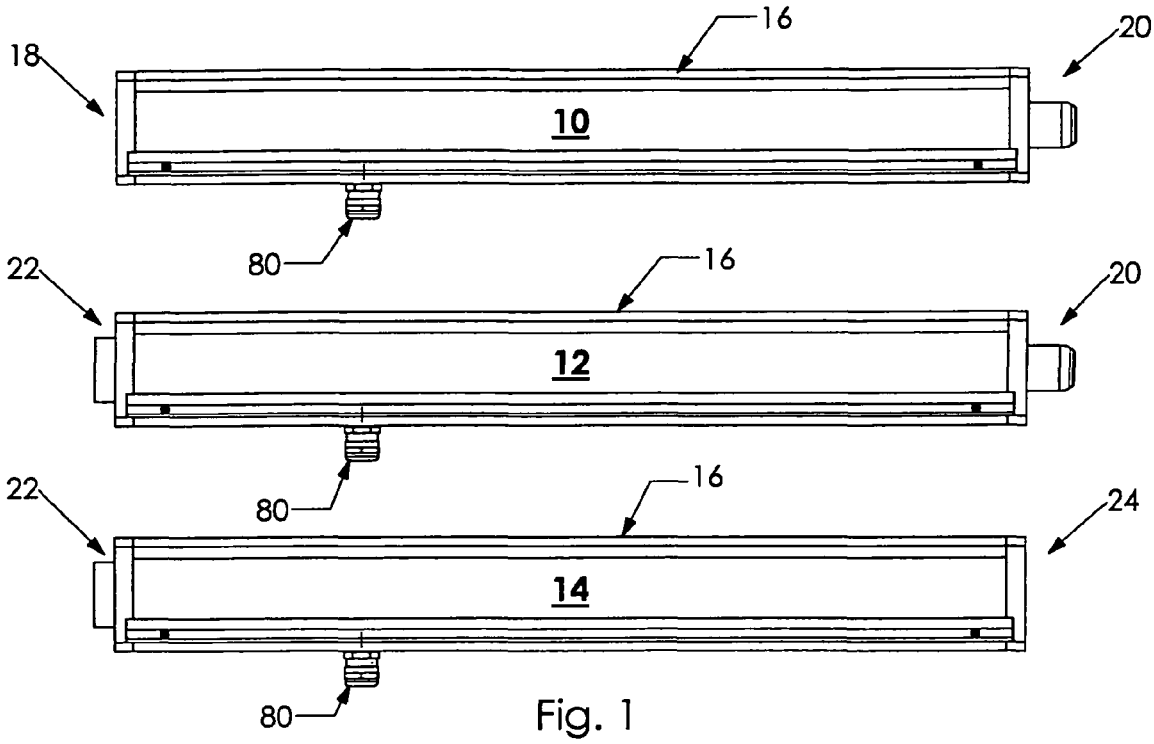
FIG. 1 depicts a series of lighting fixtures having the hubs of the present invention.

FIG. 1 depicts the various components of an architectural lighting system incorporating the present invention. The architectural lighting system may include two or three different individual fixtures. The fixture at the top of the figure is a starter fixture 10 having an elongated body 16 terminating at a fixed or solid hub 18 at one end extending to a starter hub 20 at the opposite end. The middle fixture in the figure is an intermediate fixture 12 having an elongated body 16 preferably identically shaped with respect to elongated body 16 of the starter fixture 10. The intermediate fixture 12 includes an ender hub 22 on one end and a starter hub 20 on the opposite end. The starter hub 20 of intermediate fixture 12 is identical to the starter hub 20 of the starter fixture 10. At the bottom of the figure is ender fixture 14, which has an elongated body 16 also preferably identical in configuration to the elongated body 16 of the starter fixture 10 and intermediate fixture 12. The ender fixture 14 has an ender hub 22 identical to the ender hub 22 of intermediate fixture 12. At an opposite end of the ender fixture 14 from the ender hub 22 is a solid hub 24. While the respective elongated bodies 16 preferably have identical cross-sectional dimensions, the lengths of each fixture may be the same or they may be different.

Figure 2:
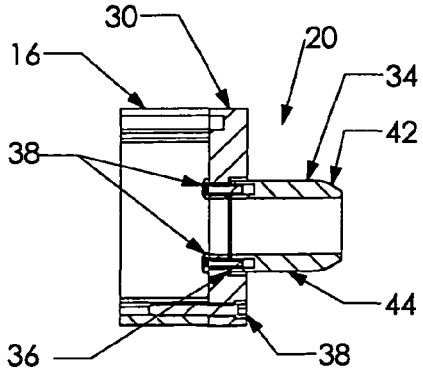
FIG. 2 depicts a cross sectional view through the starter hubs of FIG. 1.
Figure 3:
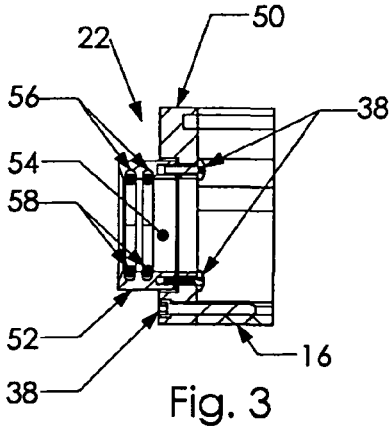
FIG. 3 depicts a cross sectional view through the ender hubs of FIG. 1
Figure 4:
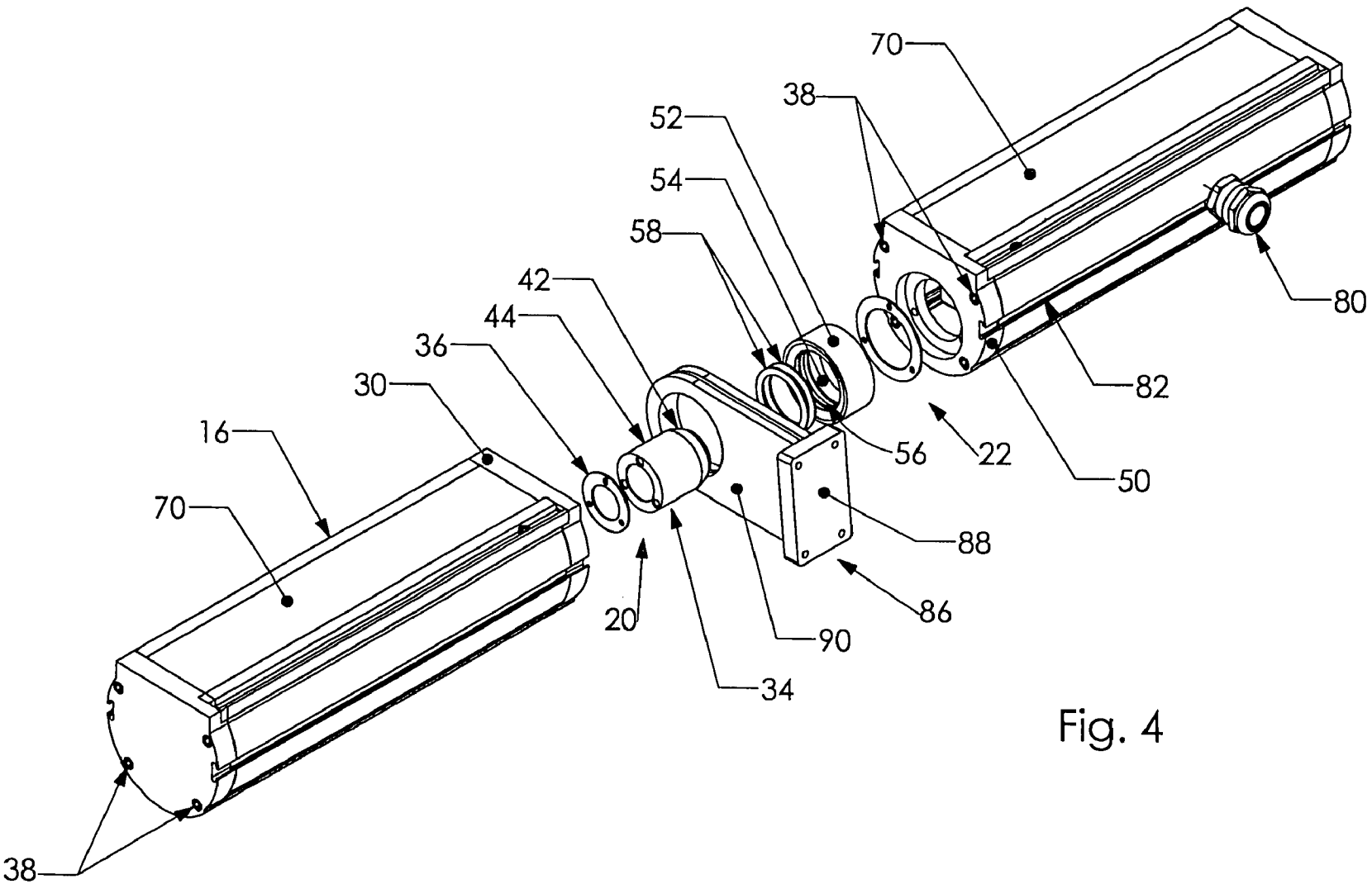
FIG. 4 is an exploded view of the components of a lighting system, having the interconnect hubs of the present invention.
Figure 5:
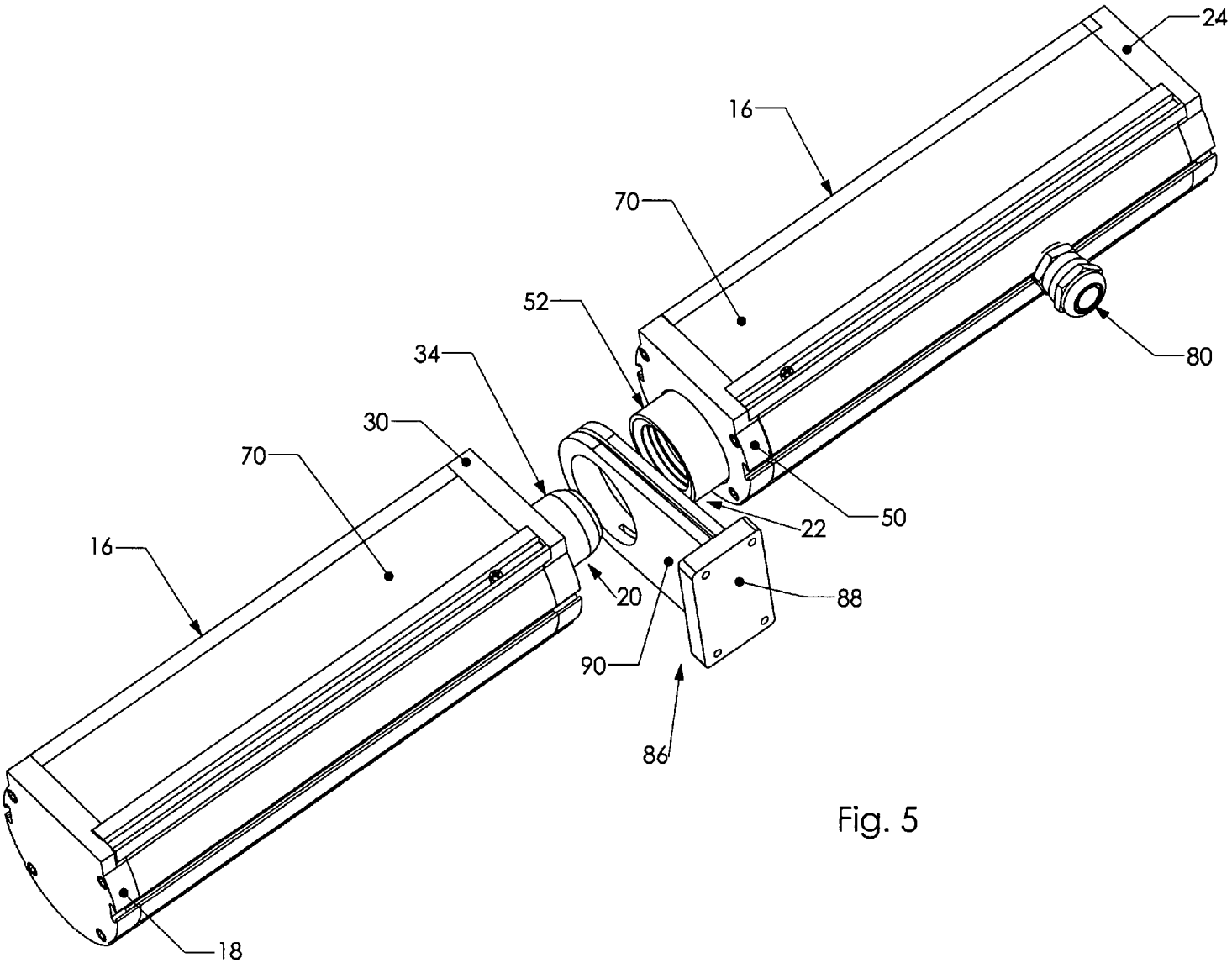
FIG. 5 depicts the respective starter hub and ender hub portions spaced apart so as to depict the relative orientations and the features thereof.
Figure 8:
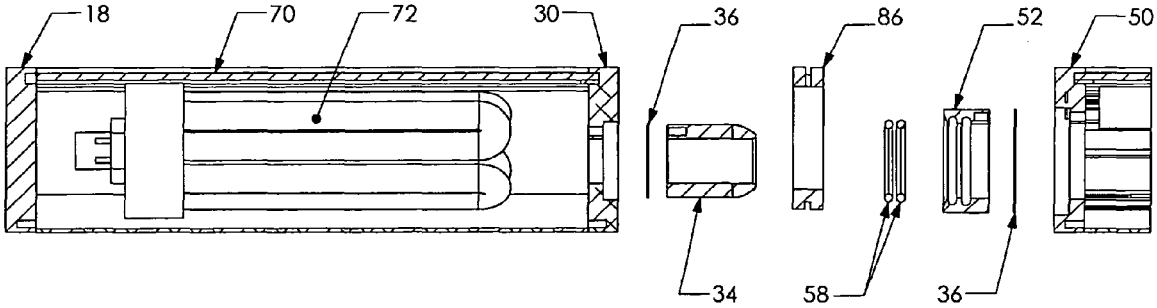
FIG. 8 is an exploded-cross section through the hubs and fixtures of the present invention.

The starter hub 20 depicted in FIGS. 1 and 2 as well as in the cross sectional view of FIG. 8 is intended to be secured to an end of the elongated body 16 of the respective fixture 10 or 12. Accordingly, the starter hub 20 includes a cap section or end cap 30 having channel or recess 32 in which is mounted a generally cylindrical connect element 34 sealed, for example, with a gasket 36. Alternatively, the connection could be sealed using a bonded gasket, which would be bonded to the entire length of the annular surface, eliminating the need for machining and providing load distribution for the connection for greater rigidity. Another alternative form of sealing and assembling the components include conformable coatings and structural-adhesives including epoxies, acrylics, methylmethacrylates (MMAs), modified silanes, and polyurethanes.

The end cap 30 may also include a plurality of holes accommodating screws 38 to allow the end cap 30 to be secured to an end of the elongated body 16. While a plurality of screws 38 are depicted in the present application, it may be appreciated that the end cap 30 could be secured to the elongated body 16 by a snap fit components, rivets, spot welds or other fixation devices including conformable coatings and structural-adhesives such as epoxies, acrylics, methylmethacrylates (MMAs), modified silanes, and polyurethanes.

To allow disassembly, screws 38 may be used to secure the cylindrical connect element 34 to the end cap 30, compressing gasket 36. Alternatively, the gasket 36 could be eliminated by securing the cylindrical connect element 34 to the end cap 30 using conformable coatings or structural-adhesives such as epoxies, acrylics, methylmethacrylates (MMAs), modified silanes, and polyurethanes.

The cylindrical connect element 34 of the end cap 30 extends out from said end cap so as to allow interconnect to be an adjacent ender hub 22. The cylindrical connect element 34 may include a beveled or rounded leading edge 42 in advance of a constant diameter cylindrical section 44.

As also depicted in FIGS. 1-3 and 4, the ender hub 22 includes an end cap 50 configured generally identical to the end cap 30 so as to allow the end cap 50 to be secured to the end of the elongated body 16. Similar to the end cap 30, the end cap 50 may be secured with a plurality of screws 38 or other securing methods as noted above to fix the end cap 50 to the elongated body 16. With respect to the interconnect capability, however, ender hub 22 includes a projecting cylinder 52 the cylindrical interior 54 of which has at least one channel 56 to preferably accommodate a pair of o-rings 58. While the device may include a singular o-ring 58, it has been found beneficial to include a pair of o-rings in the channel 56 so as to increase the imperviousness to water influx. The o-rings 58 may be of a similar material or they may be of dissimilar materials having dissimilar elastomeric properties. For example, the o-rings 58 may be made of rubber or neoprene, or one may be of rubber and the second of neoprene.

As an alternative to the internal o-rings 58, it may be appreciated that the cylindrical connect element 34 of the starter hub may include a channel or channels to accommodate o-rings to seal the connection with the projecting cylinder 52 of the ender hub 22. The cylinder 52 is intended to allow insertion of the cylindrical connect element 34 of end cap 30 having a tight fit between the outer diameter of the cylindrical section 44 and the inner diameter of the cylindrical interior 54 of cylinder 52 such that the o-rings 58 create a seal as between the respective cylindrical section 44 and the cylinder 52.

Figure 6:
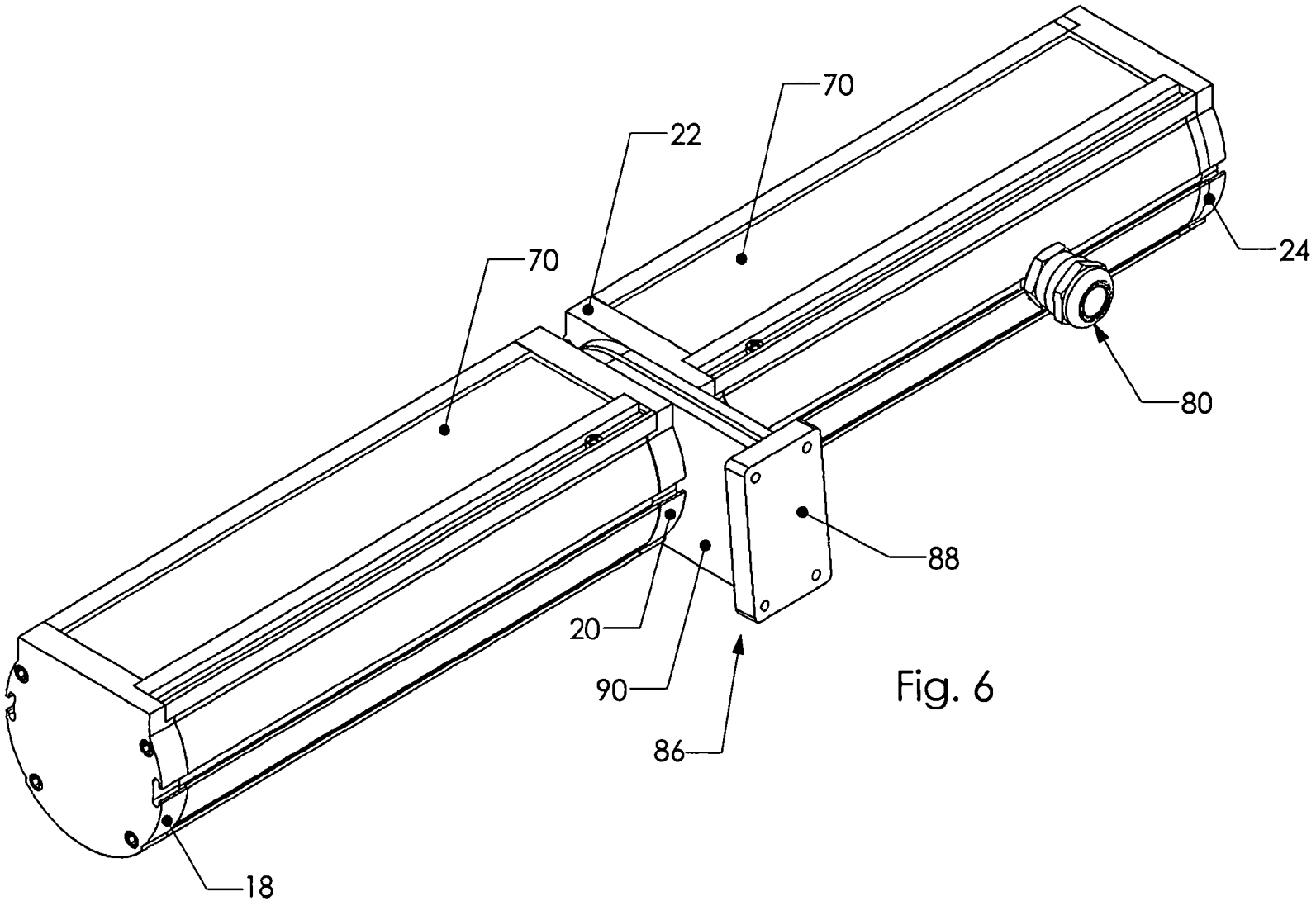
FIG. 6 depicts the assembled hubs and fixtures wherein the fixtures are in an aligned rotational relationship.

As also depicted in both the cylindrical connect element 34 and the cylinder 52 are hollow so as to allow electrical wiring or couplings to be fed through and interconnected prior to the respective fixtures being secured together as shown for example in FIG. 6. Water-tight connectors 80, provide a coupling to allow for incoming power. The water-tight connectors 80 are preferably configured so as to be secured to the elongated body 16 of one of the fixtures. As depicted in the present drawings, the elongated body 16 and the end caps 30, 50 may have a channel or slot 82 accommodating an end piece 84 acting as the securing element of the water-tight connectors 80.

Figure 7:
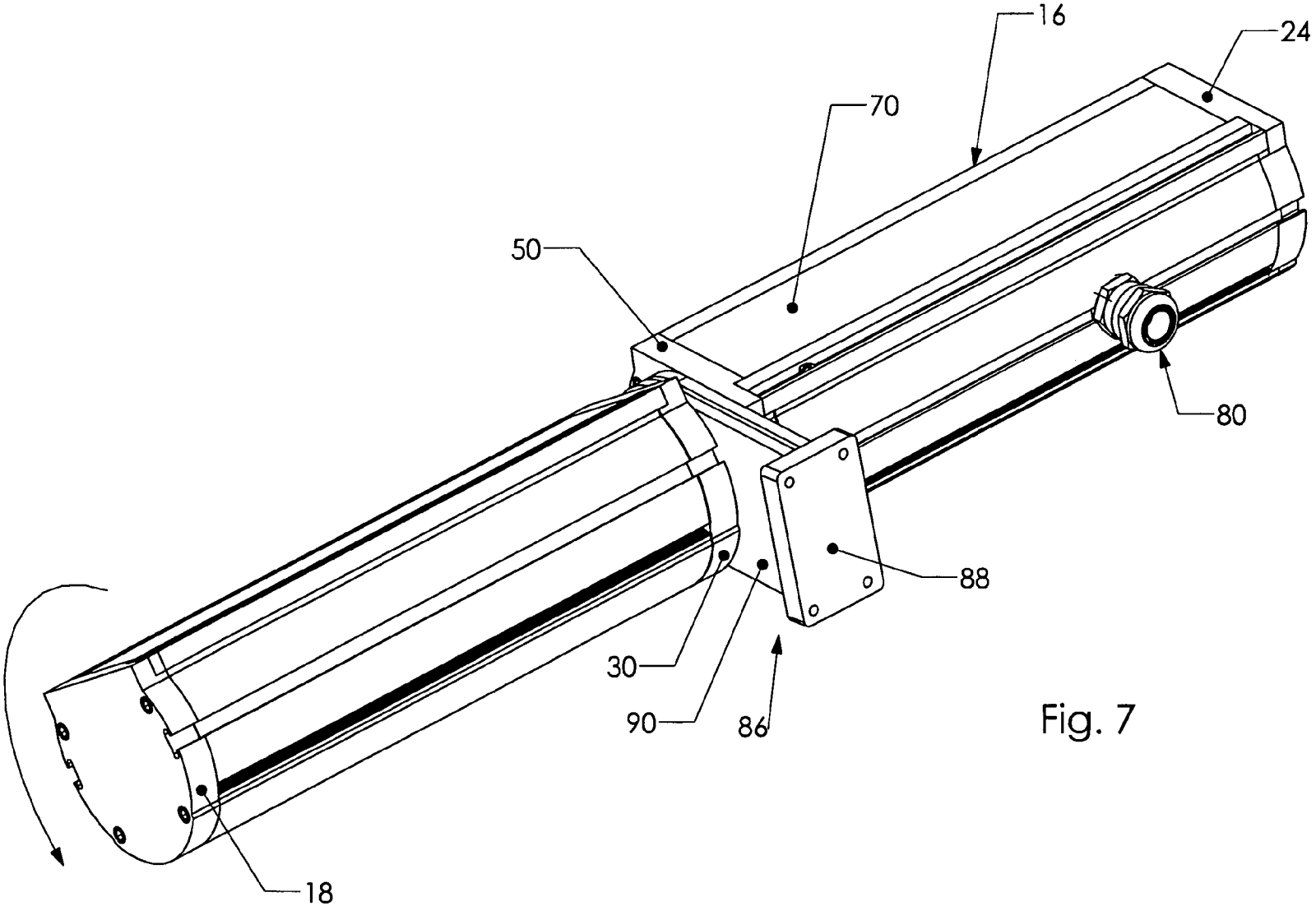
FIG. 7 depicts the assembled hubs and fixtures illustrating the capability of rotation of one fixture with respect to the second fixture.

As shown in FIGS. 6 and 7, even after the respective fixtures are secured together they may be rotated one relative to the next without being pulled apart. Once they are position, however, they may be secured in place by securing the respective fixtures to mounting brackets 86, when the mounting brackets 86 are attached to an adjacent support structure such as a wall (not shown). Various configurations of bracket 86 will allow mounting of the respective fixtures to a load bearing support such as a wall or ceiling.

Mounting brackets 86, as shown in FIG. 6, are preferably configured so as to be secured around the pass through hub. Mounting brackets 86 include a flange section 88, which may be secured to a load bearing support such as a wall or ceiling (not shown), and an extension 90 projecting from the flange. The projection 90 preferably includes a receiving channel (not shown) allowing pass through of the projecting cylinder 52 of the ender hub 22.

When the assembled components are interconnected using the push fit waterproof interconnection hubs of the present invention, they are sealed as against water passing between the interior-diameter of the cylinder 52 and the outer-diameter of the cylindrical connect element 34. As assembled, water will not seep into the interior of the light fixture assemblies and interfere with the electrical interconnects passing through the hub fixtures.

As depicted in the foregoing drawings, the elongated body 16 of the respective fixtures has a generally "'c'-shaped configuration with the open portion of the 'c'" accommodating a glass insert 70 so as to allow a light element such as a fluorescent light 72 (FIG. 8) to be inserted and mounted within the elongated body 16. The glass insert 70 allows for both sealing as against the external environment and protection for the fluorescent light 72. The electrical components for the fluorescent light fixture may also be mounted into the interior portion of the generally c-shaped cross-section of the elongated body 16. It may be appreciated that other configurations for the elongated body may be accommodated as well and that these other cross-sectional configurations could still be adapted so as to receive the end cap 30 and end cap 50 having their features accommodated to match to the cross-sectional features of the respective elongated body. Incorporation of the pass-through elements and the push fit waterproof interconnection hubs as described above, however, can still allow the prospective fixtures to be assembled together so as to be mutually rotatable if desirable and then secured in place with brackets.

As depicted and noted and described above, there may be three different fixture components to the system. The starter fixture 10 includes 1 starter hub 20 which may be secured to an ender fixture 14 to form a two fixture assembly. Alternatively, there may be one or more intermediate fixtures 12 interspersed between a starter fixture 10 and an ender fixture 14 to allow an assembly consisting of three or more fixtures to piece together to form a lighting system of any desirable length to suit the particular architectural requirement. In addition, while it is discussed as being particularly adapted to the utilization and incorporation of fluorescent light bulbs which may be 3, 4 or 5 feet in length, it may be appreciated that the respective fixtures could also accommodate light emitting diode arrays (LED arrays) to provide the lighting components so as to obtain the benefit of low-energy usage and also to provide for more light saturation and potentially different colors and effects. As the respective lighting elements that are used in the respective fixtures does not significantly impact the design of the interconnection hubs, however, it may be appreciated that the interconnection hubs of the present invention can be adapted to multiple different stylized designs for the fixture cross-sections as well as different light emitting devices incorporated into the respective fixtures.

The respective components of the fixture as well as the end caps may be formed from suitable plastics, engineered materials or metallic components such as aluminum or stainless steel components. Preferably, for weight and rigidity purposes, it would be beneficial to form the respective components of the same material such as a light weight aluminum. The elongated body 16 of the respective fixtures can be extruded where as the end caps may be machined. The respective cylinders may be machined either integrally with the end caps or they may be provided as inserts secured to the end caps at a flange internal to the end cap or threaded in so as to be screwed in to the end cap. The respective mechanism for fixing the cylinders of the interconnection hubs can accommodate multiple different configurations or a securement means without deviating from the concept of the present invention.

By the foregoing, applicants described and depicted the preferred configuration of a waterproof interconnection hubs and sequence of lighting fixtures according to the present invention. However, alternative configurations may be appreciated by those skilled in the art once upon review of the present disclosure. Accordingly, the scope of the invention is not to be limited to what is depicted identically within the respective figures and described herein, but only by the appropriate understanding and interpretation of the appending claims.

What is claimed is:

1. A light fixture assembly, comprising:

at least two fixtures each including an elongated body for containing light emitting devices;

a starter hub secured to one end of one of said at least two fixtures and including a hollow cylindrical extension projecting from said starter hub;

an ender hub secured to one end of another of said at least two fixtures, to allow coupling to said starter hub, said ender hub including a hollow cylindrical extension projecting from ender hub, said hollow cylindrical extension including at least one internal circumferential channel; and at least one o-ring inserted into said at least one internal circumferential channel.

2. The light fixture assembly of claim 1, said starter hub further comprising:

an end cap having a peripheral configuration to match the shape of an end of said elongated body and a recess accommodating mounting of said hollow cylindrical extension.

3. The light fixture assembly of claim 2, said starter hub further comprising a gasket interposed between said recess of said end cap and said hollow cylindrical extension.

4. The light fixture assembly of claim 1, said ender hub further comprising:

an end cap having a peripheral configuration to match the shape of an end of said elongated body and a recess accommodating mounting of said hollow cylindrical extension.

5. The light fixture assembly of claim 4, said ender hub further comprising a gasket interposed between said recess of said end cap and said hollow cylindrical extension.

6. The light fixture assembly of claim 2, wherein hollow cylindrical extension of said starter hub is secured in said end cap with a structural-adhesive selected from the group consisting of epoxies, acrylics, methylmethacrylates, modified silanes, and polyurethanes.

7. The light fixture assembly of claim 4, wherein said hollow cylindrical extension of said ender hub is secured to said recess of said end cap with a structural-adhesive selected from the group consisting of epoxies, acrylics, methylmethacrylates, modified silanes, and polyurethanes.

8. The light fixture assembly of claim 2, wherein said starter hub is secured to said elongated body with a conformable coating or a structural-adhesive selected from the group consisting of epoxies, acrylics, methylmethacrylates, modified silanes, and polyurethanes.

9. The light fixture assembly of claim 4, wherein said ender hub is secured to said elongated body with a conformable coating or a structural-adhesive selected from the group consisting of epoxies, acrylics, methylmethacrylates, modified silanes, and polyurethanes.

10. The light fixture assembly of claim 1 wherein said elongated body, said starter hub, said ender hub and said hollow cylindrical extensions are all formed from aluminum.

11. The light fixture assembly of claim 1 wherein said elongated body, said starter hub, said ender hub and said hollow cylindrical extensions are all formed from plastic.

12. The light fixture assembly of claim 1 further comprising a pair of o-rings inserted into said at least one internal circumferential channel.

13. The light fixture assembly of claim 8 wherein said pair of o-rings are formed from dissimilar materials.

14. The light fixture assembly of claim 8 wherein one of said pair of o-rings is formed from rubber and a second of said pair of o-rings is formed from neoprene.

15. The light fixture assembly of claim 1 further comprising brackets to allow securing of the elongated body of each of said at least two fixtures to a support structure.

16. The light fixture assembly of claim 1 further comprising three separate light fixture elements each including an elongated body for containing light emitting devices, one of said light fixtures including a starter hub on one end and an ender hub at an opposite end.

17. The light fixture assembly of claim 1 wherein each of said at least two fixtures include an elongated body having equal lengths.

18. The light fixture assembly of claim 1 wherein at least one of said at least two fixtures has an elongated body which is of a length not equal to the length of any other elongated body of said fixtures.

* * * * *